United States Patent [19]

Taylor

[11] 4,040,205

[45] Aug. 9, 1977

[54] SPINNING BALANCE TOY

[75] Inventor: Peter Taylor, Decatur, Ill.

[73] Assignee: David V. Munnis, Champaign, Ill.

[21] Appl. No.: 661,957

[22] Filed: Feb. 27, 1976

[51] Int. Cl.[2] ..... A63H 1/32

[52] U.S. Cl. ..... 46/51; 273/1 R

[58] Field of Search ..... 46/51; 273/1 R

[56] References Cited

U.S. PATENT DOCUMENTS

| | | | |
|---|---|---|---|
| 3,484,985 | 12/1969 | Castell | 46/51 |
| 3,829,087 | 8/1974 | Kuney | 46/51 |

*Primary Examiner*—Louis G. Mancene
*Assistant Examiner*—Robert F. Cutting
*Attorney, Agent, or Firm*—David V. Munnis

[57] ABSTRACT

Game-of-skill toy having a main frame adapted to be rotated repeatedly in a 360° arc by the user which includes one or more laterally projecting support points upon which normally removable small objects, e.g., discs, are balanced and maintained in place, initially by gravity, and, during rotation of the frame, by centrifugal force.

4 Claims, 2 Drawing Figures

SPINNING BALANCE TOY

BACKGROUND OF THE INVENTION

This invention relates to a game-of-skill, spinning, balance toy.

Of the numerous toys previously proposed in the prior art, the great majority suffer one or more drawbacks economically due to limitations inherent to their design or function. For maximum consumer appeal, a toy should have a characteristic design and function to be adapted for use by persons of all ages, indoors and outdoors, require some physical exertion, entail some, or better yet, varying degrees of skill for mastery, and supply entertainment when used by a solitary manipulator or by several in mutual competition. A further characteristic, of course, is a simplicity resulting in ease of manufacture and low cost.

Certain spinning toys, such as those commonly known as "hula-hoops" and "Frisbies" meet such requirements and, thus, have met with relatively wide commercial success, and the search has continued in the art for additional toys having such characteristics.

OBJECTS OF THE PRESENT INVENTION

Accordingly, it is the primary object of the present invention to provide a novel spinning, balance toy.

It is another object of the present invention to provide a novel balance toy adapted for use by persons of all ages, indoors and outdoors.

An additional object of the present invention is to provide a novel balance toy which, in its operation, requires its user to exert himself physically and spin or rotate same.

Yet another object of the present invention is to provide a novel balance toy which, in its use, requires sufficient skill to be adapted to provide entertainment to a solitary user or several users engaging in mutual competition.

Still a further object of the present invention is to provide a novel spinning-balance toy of relatively simple design and which is adapted to be manufactured and marketed at a relatively low economic cost.

DESCRIPTION OF THE DRAWINGS

By means of the present invention, a novel toy is provided advantageously satisfying the above and other objects as will be apparent from the description thereof. A broad and more detailed description of the toy of the present invention appears below, with reference being made to the accompanying drawings, of which.

DETAILED DESCRIPTION OF THE PRESENT INVENTION

Broadly described, the present invention comprises a spinning balance toy comprising a portable frame member adapted for manual rotation in a vertical plane about a horizontal axis, an opening in said frame having an axis which is coaxial to said axis of rotation of said frame, said frame opening thereby adapting said frame to be manually supported vertically by a member inserted into said frame opening, at least one pointed balance member, positioned fixedly to said frame, said pointed balance member being located on said frame at a point removed from said axis of rotation of said frame and having a terminus which, when said frame is supported in a vertical plane, extends upwardly and is truncated at its end to define a horizontal surface, and at least one goal or target element, said goal or target element having a bottom surface of larger cross-sectional area than that of said horizontal terminus of said pointed balance member and being adapted for removable, slideable engagement with and for support by gravity upon said horizontal terminus of said pointed balance member.

Figure 1:
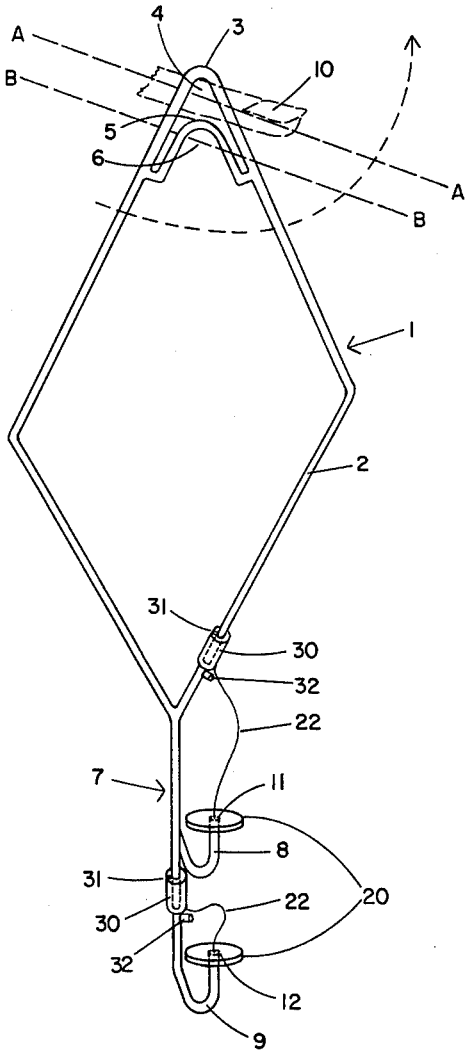
FIG. 1 is a diagramatic representation, in perspective, of an embodiment of the toy thereof.

With reference to the attached drawings, in FIG. 1 generally designates the frame of the embodiment of the toy of the present invention shown. Frame 1 as shown, includes a wire-like frame portion in the form of a rectangle 2 having at its upper end 3, when frame 1 is placed in a vertical plane, an opening 4 through which a horizontal axis A—A passes. Opening 4 in frame 1 is of such a size and so located to be adapted to receive a horizontal member, such as a finger 10 of an operator of the toy, and thereby manually support frame 1 in a vertical plane and allow frame 1 to be rotated about axis A—A, as shown by the dotted arrow, in an arc up to and over 360°.

While frame 1, as shown, includes a wire-like body element 2, frame 1, except for opening 4, may be a semi-solid or solid member having an outside configuration defining a similar rectangle, another angular shape, a circular or other arcuate shape, or combination thereof, have outside surfaces which similarly define planes, surfaces of revolution, or combinations thereof, and be formed of any suitable metalic, plastic, or other materials, so long as frame 1 is of such a size and shape to be adapted to be portable to humans and rotatable about an axis such as axis A—A.

At a point removed from axis A—A, frame 1 has fixedly attached thereto through a supplemental support element 7 here shown as being wire-like, at least one pointed balance element adapted to support, by gravity initially and then by centrifugal force when frame 1 is rotated, a goal or target element which is removable from and having a larger cross-sectional area on its surface contacting the pointed balance member. A pointed balance member suitably may be formed of the same or a different material as body element 2 of frame member 1 and be of any general length and any external configuration. In the embodiment shown in FIG. 1 two pointed balance members are provided represented by upwardly extending wire-like members 8 and 9. Pointed balance members 8 and 9 have termini 11 and 12, respectively, which define horizontal planes when frame 1 is supported about axis A—A in a vertical plane. As shown, termini 11 and 12 at their respective ends each define circular configurations, such a configuration is not critical, and the horizontal plane defined by the truncated end of such termini suitably may be angular, dissimilarly arcuate, and the like. The one or more pointed balance elements provided suitably may be so positioned with respect to main body element 2 of frame 1, such that a normal to the horizontal end of its terminus may fall in the same vertical plane as body portion 2, as does a normal of terminus 11 of balance member 8, or may fall in a plane parallel to that of body portion 2, such as does that of terminus 12 of balance member 9.

In accordance with the toy of the present invention, a target element is provided which is adapted for slideable, removable engagement with the horizontal surface of the terminus of a pointed balance element. Each target element has a lower surface for contacting the terminus of the balance element which has a greater horizontal cross-sectional area than that of the balance element terminus. The target element is designed to be adapted to be initially balanced and supported on the balance element terminus upon which it is located initially by gravity and subsequently be centrifugal force when frame 1 is rotated about axis A—A through continuous successive arcs of 360 degrees.

Figure 2:
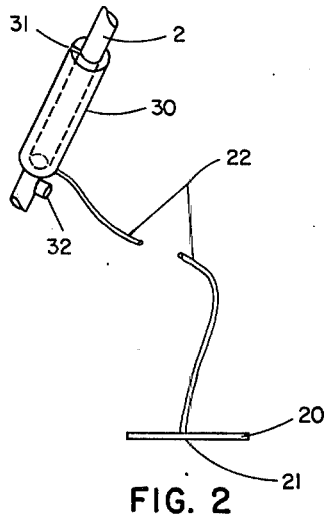
FIG. 2 is a diagramatic representation, partly in perspective, and partially broken away, depicting embodiments of the balanceable objects, e.g., discs, and auxiliary safety retaining means therefore of the embodiment of the game of the present invention shown in FIG. 1.

Subject to the above, the size and configuration of a target element is not critical, and suitable target elements may be in the form of those having angular or arcuate configurations. In a preferred embodiment, as shown in FIGS. 1 and 2, the target elements are in the form of flat discs 20 having a horizontal cross-sectional area significantly greater than the horizontal truncations 11 and 12, respectively, upon which they are placed for manipulation of the toy.

A target element 20 suitably may be employed in the toy of the present invention with or without auxiliary safety retaining means. In the more preferred embodiments of the present invention, such safety retaining means are provided to prevent a target element 20 from flying off, during attempted manipulation of the toy, having to be retrieved, and even possibly being lost. In the embodiment shown in FIG. 1, such supplemental retaining means is provided by a flexible thread-like member 22 attached at one end to the upper surface of each target element 20 and at the other end to body 1 through flexible tab elements 30 which, by virtue of being formed of a flexible material and having slots 31 along their lengths, are adapted to be attached and removed under pressure from body frame 1 as desired. This latter feature, in combination with the provision of a set of target elements 20 having increased smoothness on the lower surface 21 thereof, and consequently increased ease of loss from balance elements 8 and 9 during serial operation of the toy with each respective series of discs, allows such different discs to be mounted within the toy and provide a toy having increasingly difficult degrees of skill requisite to its operation; thus, providing a toy advantageously conducive to continuing interest in both solitary use and in competition among two or more users.

While the above description has been with respect to an embodiment having one axis of rotation, the toy of the present invention suitably may be adapted with one or more additional openings in frame 1 allowing for variable rotation of the toy from a start or during operation. As shown in FIG. 1, frame 1 may be provided, such as by inclusion of auxiliary wire-like member 5, with a second opening 6 through which frame 1 may be supported and rotated about axis B—B.

I claim:

1. A spinning balance toy comprising a portable frame member adapted for manual rotation in a vertical plane about a horizontal axis, an opening in said frame having an axis which is coaxial to said axis of rotation of said frame, said frame opening thereby adapting said frame to be manually supported vertically by a member inserted into said frame opening, at least one pointed balance member, positioned fixedly to said frame, said pointed balance member being located on said frame at a point removed from said axis of rotation of said frame and having a terminus which, when said frame is supported in a vertical plane, extends upwardly and is truncated at its end to define a horizontal surface, at least one target element, said target element having a bottom surface of larger cross-sectional area than that of said horizontal terminus of said pointed balance member and being adapted for removable slideable engagement with and for support by gravity upon said horizontal terminus of said pointed balance member, and a safety retaining means attached to said target element, said safety retaining means comprising a separate flexible line attached at one end to the upper surface of said target element and removeably attached at the other end to said frame.

2. The toy according to claim 1 wherein said target element is a flat disc.

3. The toy according to claim 1 having a plurality of said pointed balance members and said target elements.

4. The toy according to claim 3 wherein said target elements are flat discs.

* * * * *